US006048241A

United States Patent [19]

Traksel et al.

[11] Patent Number: 6,048,241

[45] Date of Patent: Apr. 11, 2000

[54] METHOD OF MANUFACTURING A LOW-PRESSURE MERCURY DISCHARGE LAMP

[75] Inventors: Frans J. Traksel; Antonius J. Spaapen, both of Roosendaal, Netherlands

[73] Assignee: U.S. Philips Corporation, New York, N.Y.

[21] Appl. No.: 09/235,365

[22] Filed: Jan. 21, 1999

Related U.S. Application Data

[62] Division of application No. 08/741,162, Oct. 29, 1996.

[30] Foreign Application Priority Data

Oct. 30, 1995 [BE] Belgium ..... 9500896

[51] Int. Cl.[7] ..... H01J 9/38

[52] U.S. Cl. ..... 445/9; 313/546; 313/490

[58] Field of Search ..... 445/9; 313/490, 313/546

[56] References Cited

U.S. PATENT DOCUMENTS

| | | | |
|---|---|---|---|
| 3,684,345 | 8/1972 | Schiekel et al. | 316/4 |
| 3,913,999 | 10/1975 | Clarke | 445/9 |
| 4,278,908 | 7/1981 | Antonis | 313/177 |
| 4,534,742 | 8/1985 | Grossman et al. | 445/9 |
| 4,907,998 | 3/1990 | Kuijer et al. | 445/9 |

*Primary Examiner*—Vip Patel
*Assistant Examiner*—Todd Reed Hopper
*Attorney, Agent, or Firm*—F. Brice Faller

[57] ABSTRACT

A capsule (20) having a glass wall (21) and containing mercury is positioned in a radiation-transmitting discharge vessel, after which the discharge vessel is provided with a rare gas and closed, means for maintaining an electric discharge are arranged in or adjacent the discharge vessel. The capsule is opened by fusion after the discharge vessel has been closed by heating the capsule by irradiation (42) with a parallel beam of radiation through the wall of the discharge vessel. The wall of the capsule has for this radiation an absorption coefficient which amounts at least ten times that of the wall portion of the discharge vessel.

3 Claims, 3 Drawing Sheets

METHOD OF MANUFACTURING A LOW-PRESSURE MERCURY DISCHARGE LAMP

CROSS REFERENCE TO RELATED APPLICATIONS

This is a divisional of application Ser. No. 08/741,162, filed Oct. 29, 1996.

BACKGROUND OF THE INVENTION

The invention relates to a method of manufacturing a low-pressure mercury discharge lamp wherein a capsule containing mercury is arranged in a radiation-transmitting discharge vessel, after which the discharge vessel is provided with a rare gas and is closed, and wherein means for maintaining an electric discharge are arranged in or adjacent the discharge vessel and the capsule is opened after the discharge vessel has been closed, the capsule being opened by irradiation through a wall portion of the discharge vessel.

The invention also relates to a low-pressure mercury discharge lamp provided with a radiation-transmitting discharge vessel which is closed in a gastight manner and which contains an ionizable filling comprising mercury, while a capsule with a glass wall having an opening is arranged in the discharge vessel and the lamp is in addition provided with means for maintaining an electric discharge in a discharge space surrounded by the discharge vessel.

U.S. Pat. No. 4,278,908 describes a method of dosing mercury in a conventional low-pressure mercury discharge lamp, i.e. a low-pressure mercury discharge lamp provided with a tubular discharge vessel with an electrode positioned at either end, current supply conductors extending from each electrode to outside the discharge vessel. According to the U.S. Patent, the mercury is dosed by means of a glass capsule provided with a perforated metal envelope by means of which it is fastened to an end portion of the discharge vessel. In the known method, the capsule is heated in that the lamp is positioned in a high-frequency magnetic field. Eddy currents arise in the metal envelope of the capsule then, which lead to a heat generation which cause the glass capsule to melt at the area of the perforation, so that the mercury present in the capsule becomes available in the discharge vessel.

It is a disadvantage that the metal envelope of the capsule forms an additional component which involves additional manufacturing, storage, transport, and assembling costs.

From DE-OS 2 340 885 (U.S. Pat. No. 3,913,999) a method of manufacturing a fluorescent lamp is known according to which an aluminum, mercury containing capsule is opened by irradiation through a wall portion of the discharge vessel.

According to this method a radiation source aims a narrowing beam of radiation at the capsule such that the beam is wide in the location where it passes through the wall portion of the discharge vessel compared with a focal spot of the beam which coincides with the wall of the capsule. It is a disadvantage of this method that the radiation intensity at the area of the capsule wall is dependent on the distance to the radiation source. Furthermore, it is a disadvantage that the discharge vessel may become damaged if the focal spot of the beam approaches the wall of the discharge vessel to closely. Therefore, the lamp must be accurately positioned during irradiation.

SUMMARY OF THE INVENTION

An object of the invention is to provide a lamp which can be manufactured comparatively easily and reliably.

According to the invention, the mercury capsule is accessible to radiation of at least a wavelength in a range from 100 nm to 5 $\mu$m incident from outside the discharge vessel through a wall portion of the discharge vessel, and the wall of the capsule has a comparatively high absorption coefficient for said radiation, i.e. at least ten times that of the wall portion of the discharge vessel. The absorption coefficient of a material is understood to be the reciprocal value of the thickness of that material which is necessary for absorbing a fraction 1−e (≈0.632) of the radiation. Owing to the comparatively high absorption coefficient of the capsule wall compared with that of the wall portion of the discharge vessel, the capsule may be irradiated with a parallel radiation beam, if so desired, so that the radiation intensity at the area of the capsule is substantially not dependent on the distance to the radiation source. A still greater tolerance as to the location can be realized when the lamp under manufacture is moved during irradiation, preferably in a direction transverse to a longitudinal direction of the capsule. A glass capsule provided with a filling comprising mercury is easier to manufacture than a capsule of ceramic material or metal. The introduction of impurities into the discharge vessel can be avoided comparatively easily when a glass capsule is used. A low melting temperature of the glass, i.e. the temperature at which the viscosity is 100 dPa, is favorable for the capsule. The capsules can then be quickly opened with a comparatively low power of the radiation source.

According to the invention, a method of manufacturing the low-pressure mercury discharge lamp of the invention comprises opening the capsule is with a parallel beam of radiation for which the glass wall of the capsule has an absorption coefficient which amounts at least ten times that of the wall portion of the discharge vessel. The capsule wall may be heated by means of a radiation beam, for example in an accurately defined location, such that the wall melts in this location and an opening is formed in the capsule. Alternatively, the capsule may be cut through by a radiation beam. Since a parallel beam of high intensity can be readily obtained by means of a laser, this radiation source is eminently suitable for use in this method. Preferably, the radiation source supplies radiation substantially within a wavelength range from 100 nm to 5 $\mu$m.

U.S. Pat. No. 3,684,345 describes a method for manufacturing a number indicator tube wherein a glass capsule containing mercury is opened by irradiation with a parallel beam, the glass of the capsule having a relatively high absorption coefficient for infrared radiation in comparison to the wall of the tube. The mercury released is deposited at the surface of the electrodes of the number indicator tube.

The discharge vessel of the low-pressure mercury discharge lamp of the invention may surround besides the discharge space also further spaces communicating with the former. The discharge vessel is provided, for example, with a projecting portion which serves as an exhaust tube during lamp manufacture.

The capsule may be removed, for example after lamp manufacture, after it has served its purpose of dispensing mercury. Alternatively, the capsule may remain in the finished lamp. It is favorable when the capsule is arranged in a projecting portion of the discharge vessel in lamps where the capsule contains an amalgam. The amalgam in the capsule may have a comparatively low temperature, depending on the distance from the capsule to the other lamp components. Alternatively, the capsule may be arranged more centrally in the discharge vessel, for example in the discharge space. Such an embodiment may be favorable when the capsule is used exclusively for dispensing mercury or when the capsule contains an amalgam which controls the mercury vapor pressure necessary for an optimum lamp operation at a comparatively high temperature. If the discharge vessel is provided with a luminescent layer, a window may be present therein for admitting radiation from outside the discharge vessel to the capsule during lamp manufacture.

Any capsule remaining in the lamp is preferably fixed therein. A loose capsule may create the impression that the lamp is defective. Changes in the burning position in combination with a loose capsule containing an amalgam may lead to variations in amalgam temperature and thus in mercury vapor pressure. The capsule may be fastened in the discharge vessel, for example, by glass fusion.

An attractive embodiment of the low-pressure mercury discharge lamp according to the invention is characterized in that the capsule is clamped by a convex portion thereof in a projecting portion of the discharge vessel. The operating temperature of the amalgam will then show only minor variations with changes in the burning position of the lamp. An even more reliable adjustment of the operating temperature of the amalgam is achieved when the amalgam also occupies a fixed position relative to the capsule. This may be realized in that the amalgam is sufficiently heated through irradiation for causing it to fuse itself to the capsule, for example, during the process step in which the capsule is made convex. The amalgam itself may be irradiated during this, or it may be heated indirectly by heat which reaches the amalgam through the capsule which is being irradiated.

Such an embodiment of a lamp according to the invention may be readily manufactured by a method according to the invention which is characterized in that the capsule containing mercury is arranged in a projecting portion of the discharge vessel and in that, after closing of the discharge vessel and before opening of the capsule, the capsule is heated by irradiation through a wall portion of the projecting portion such that the glass of the wall of the capsule softens and bulges out under the influence of the mercury vapor pressure prevailing therein, whereby it fixes itself against the inner surface of the projecting portion. The capsule may be irradiated, for example, in that the discharge vessel and thus the capsule accommodated therein are caused to pass along a beam, so that the capsule is irradiated during the time interval in which it is present in the beam. Alternatively, the discharge vessel with the capsule may occupy a fixed position in the beam while the radiation source is activated. It is possible, for example, for several radiation sources to be arranged around the capsule in order to heat the capsule evenly all around. Alternatively, the discharge vessel may be rotated during irradiation.

Thermal stresses may arise in the projecting portion of the discharge vessel, if this projecting portion is comparatively narrow, as a result of molten capsule particles colliding therewith during opening of the capsule. It is favorable when the capsule is irradiated substantially from one direction. Heating of the capsule from one direction causes the capsule to become convex mainly in said direction, so that it will occupy an eccentric position within the projecting portion of the discharge vessel. A remaining, non-convex portion of the capsule also facing this direction then has a comparatively great distance to the inner surface of the projecting portion. Said comparatively great distance reduces the risk of thermal stresses when the capsule is opened through irradiation in said non-convex portion.

An attractive embodiment of the low-pressure mercury discharge lamp according to the invention is accordingly characterized in that the capsule has an opening which faces in a direction and the capsule is made convex in said direction next to said opening.

Preferably, the process of making the capsule convex is carried out shortly before the capsule is opened. The comparatively high mercury vapor pressure in the capsule then facilitates the creation of an opening.

It is favorable when the capsule absorbs radiation with a wavelength within an interval from approximately 0.9 $\mu$m to approximately 1.5 $\mu$m comparatively strongly. Thermal radiators have a comparatively high power density in this range. This may be achieved in the case of a glass capsule, for example, in that the glass of the capsule contains a few percents by weight of the oxides FeO, CuO and/or $V_2O_3$.

Preferably, the capsule is light-transmitting for at least a portion of the visible spectrum. This simplifies inspection of the capsule contents.

It is favorable when the still closed capsule is filled with an inert gas, for example a rare gas, with a filling pressure of between approximately 1 mbar and approximately 100 mbar. Leaky capsules may be readily detected in that the capsules are passed through a high-frequency magnetic field. Correct capsules will show a clearly visible gas discharge when passing through this field, in contrast to leaky capsules, so that the leaky capsules can be removed from the production process by automatic detection means.

DETAILED DESCRIPTION OF THE PREFERRED EMBODIMENTS

Figure 1:
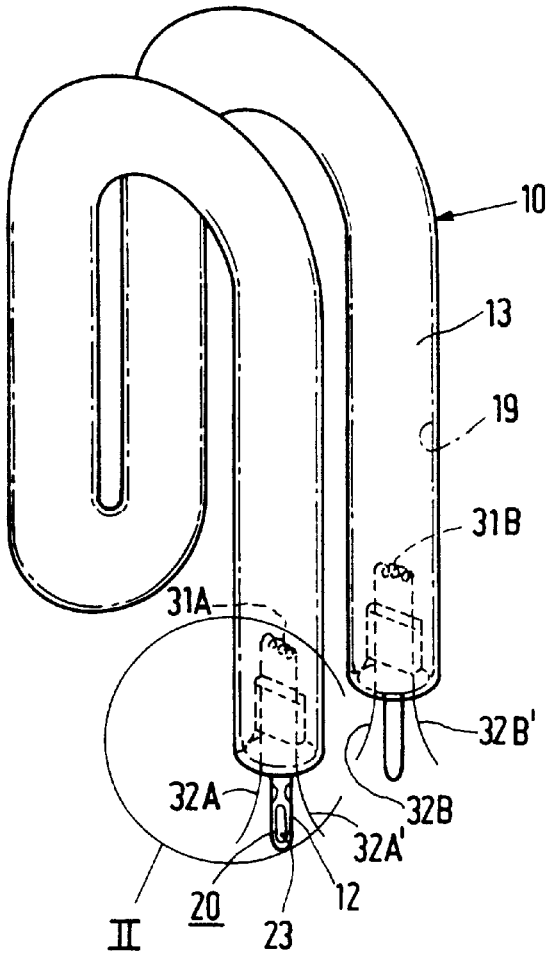
FIG. 1 is a perspective view of a first embodiment of the low-pressure mercury discharge lamp according to the invention.
Figure 2:
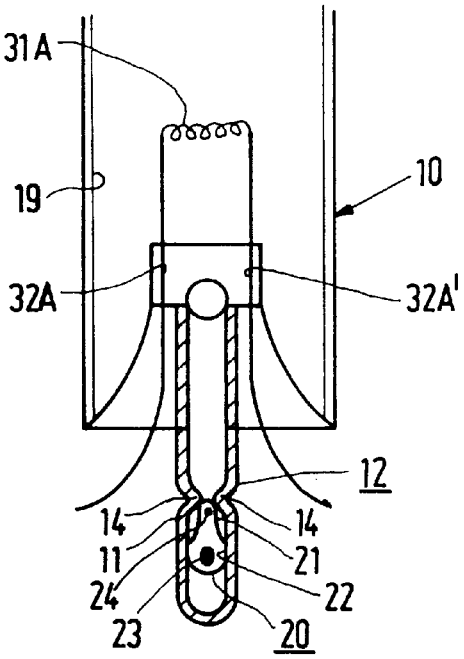
FIG. 2 shows a detail II of the lamp of FIG. 1 in side elevation.

The low-pressure mercury discharge lamp shown in FIG. 1 is provided with a radiation-transmitting lime glass discharge vessel 10 which is closed in a gastight manner. The tubular discharge vessel is bent into a hook shape here. The discharge vessel 10 is provided with an ionizable filling of mercury and argon. The discharge vessel 10 is provided with a luminescent layer 19 at an inner surface. A capsule 20 with a wall 21 of a lime glass which comprises 4.0% FeO by weight (see also FIG. 2) is arranged in the discharge vessel 10, in this case in a tubular projecting portion 12 thereof. An opening 24 has been fused in the wall 21 of the capsule 20. The capsule 20, which has a length of 13 mm, an internal diameter of 1.8 mm, and a wall thickness of 0.3 mm, contains an amalgam 23 of bismuth, indium and mercury. The melting temperature of the capsule glass is 1490° C. The lamp is furthermore provided with means for maintaining an electric discharge in the discharge space 13 surrounded by the discharge vessel 10. In the embodiment shown, the means are formed by a pair of electrodes 31A, 31B positioned in the discharge space 13. Current supply conductors 32A, 32A'; 32B, 32B' extend from each electrode 31A, 31B to outside the discharge vessel 10.

The low-pressure mercury discharge lamp has the characteristic that the capsule 20 is accessible to radiation of at least a wavelength in a range from 100 nm to 5 $\mu$m coming from outside the discharge vessel 10 through a wall portion 11 of the discharge vessel 10, and that the wall 21 of the capsule 20 has a comparatively high absorption coefficient for this radiation compared with that of the wall portion 11 of the discharge vessel. The glass of the capsule of the lamp shown has an absorption coefficient of at least 2.69 $mm^{-1}$ for the wavelength range from 0.9 to 1.5 $\mu$m. The absorption coefficient of the wall portion of the discharge vessel in this wavelength range is at most 0.0074 $mm^{-1}$. Apart from a slight reflection of approximately 5%, radiation in this wavelength range is accordingly capable of reaching the wall 21 of the capsule 20 substantially without impairment, and approximately 50% of the radiation is absorbed in the 0.3 mm thick wall 21 of the capsule 20.

Figure 3A:
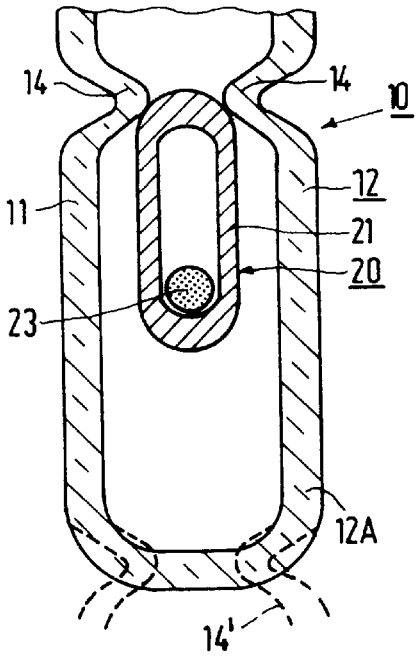
FIGS. 3A to 3C show steps in an embodiment of the method according to the invention.
Figure 3B:
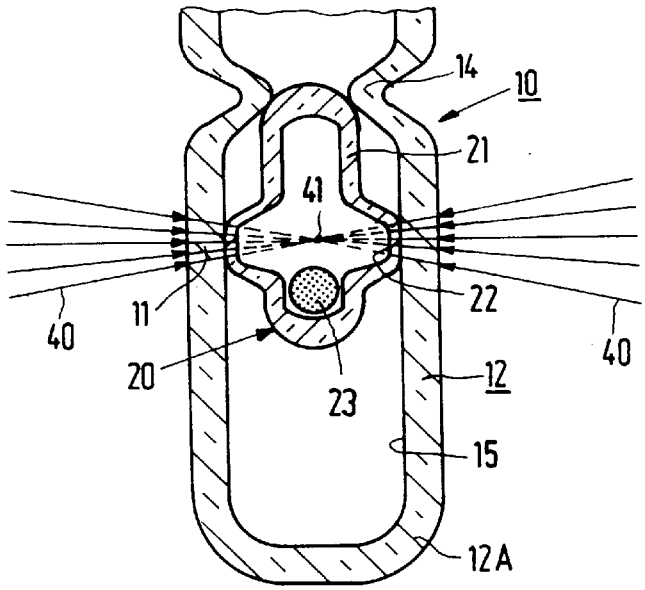
Figure 3C:
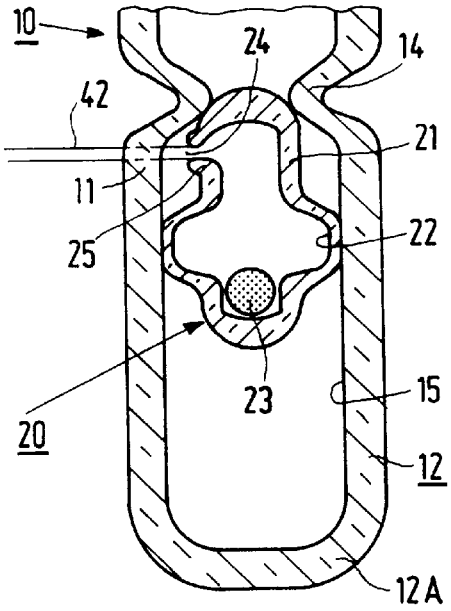

The capsule 20 has a convex portion 22 by which it is clamped in the projecting portion 12 (see also FIG. 3C).

During lamp manufacture the glass capsule 20 was provided in a tubular projecting portion 12 (see FIG. 3A) of the discharge vessel 10 and held between first constrictions 14 and second constrictions 14' (shown in broken lines) in the projecting portion 12 on either side. The capsule 20 contained an amalgam 23 of 60 mg of the alloy $Bi_{70}In_{30}$ (at/at) with 3 mg mercury and argon under a pressure of 10 mbar. After the discharge vessel 10 had been evacuated through the projecting portion 12 and had been provided with a filling of rare gas, the discharge vessel was closed in that the projecting portion 12 was fused at its free end 12A at the area of the second constrictions.

Then the capsule 20 was heated from the outside with infrared radiation 40 for 8 seconds (FIG. 3B). Thermal infrared radiation sources (not shown) with a power of 2 kW were used for this, whose radiation was focused into a focal line 41 with a length of 175 mm and a width of 2.5 mm. The discharge vessel was arranged between two such infrared radiation sources facing one another such that the focal lines of the sources coincided and the projecting portion 12 of the discharge vessel extended transversely through the joint focal line 41 of the infrared radiation sources. The glass of the capsule 20 softened during the irradiation, whereupon it bulged out under the influence of the vapor pressure of the mercury present inside the capsule and the capsule 20 adhered itself to the inner surface 15 of the projecting portion 12. As a result, the capsule 20 now occupies a fixed position relative to the discharge vessel 10. It is avoided thereby that loose components are audible. The fixed position of the capsule 20 in addition achieves a reliable adjustment of the operating temperature of the amalgam 23. The capsule 20 may rest against constrictions 14 or against the free end 12A during the process step of making it convex. During the process step of making the capsule 20 convex, the amalgam 23 in the capsule fused itself fixedly into position by means of heat which the irradiated capsule transferred to the amalgam through conduction. The amalgam 23 as a result occupies a fixed position in the capsule 20, which contributes to the reliability of the adjustment of the operating temperature of the amalgam. The discharge vessel in this case occupied a fixed position during irradiation, but alternatively the discharge vessel may be transported, for example, along the focal line. The lamp may be rotated during irradiation so as to promote an even heating of the capsule.

Subsequently, the lamp was passed with its tubular projecting portion 12 along a radiation beam 42 of a Nd-YAG laser (see FIG. 3C) with a speed of 8 mm/s. The radiation beam 42 had a power of 30 W and a diameter of 0.5 mm. The wavelength of the radiation of the beam 42 was 1064 nm. the heat generated through absorption of the radiation in the wall 21 of the capsule 20 caused the glass to melt, so that an opening 24 was created in the wall 21 of the capsule 20. The still comparatively high vapor pressure of the mercury present in the capsule 20 led to an outwardly flanged rim 25 around the opening 24 of the capsule 20. A continuous laser was used in the embodiment described. Alternatively, however, a pulse-operated laser may be used. It is possible to supply the rare gas filling from the capsule after the discharge vessel 10 of the lamp has been closed instead of providing the discharge vessel with a rare gas filling before it is closed.

Figure 3D:
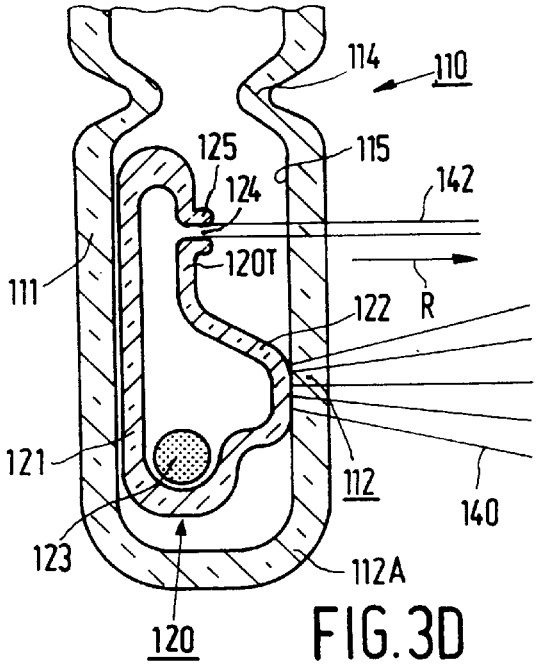
FIG. 3D shows steps of a further embodiment of the method according to the invention.

A modification of the process step shown in FIG. 3B is shown in FIG. 3D. Components therein corresponding to those of FIGS. 3B and 3C have reference numerals which are 100 higher. In the process step shown in FIG. 3D, the capsule 120 is inflated in that it is irradiated substantially from a direction R. The unilateral heating of the capsule 120 causes the latter to bulge substantially in said direction R, and thus to occupy an eccentric position within the projecting portion 112 of the discharge vessel 110. Then an opening 124 is provided in a remaining, non-convex portion 120T of the capsule 120 also facing the direction R by means of a laser beam 142 from substantially this same direction R. Owing to the comparatively great distance between the portion 120T and the inner surface 115 of the projecting portion 112 of the discharge vessel, the risk of thermal stresses in the projecting portion is small.

Figure 4:
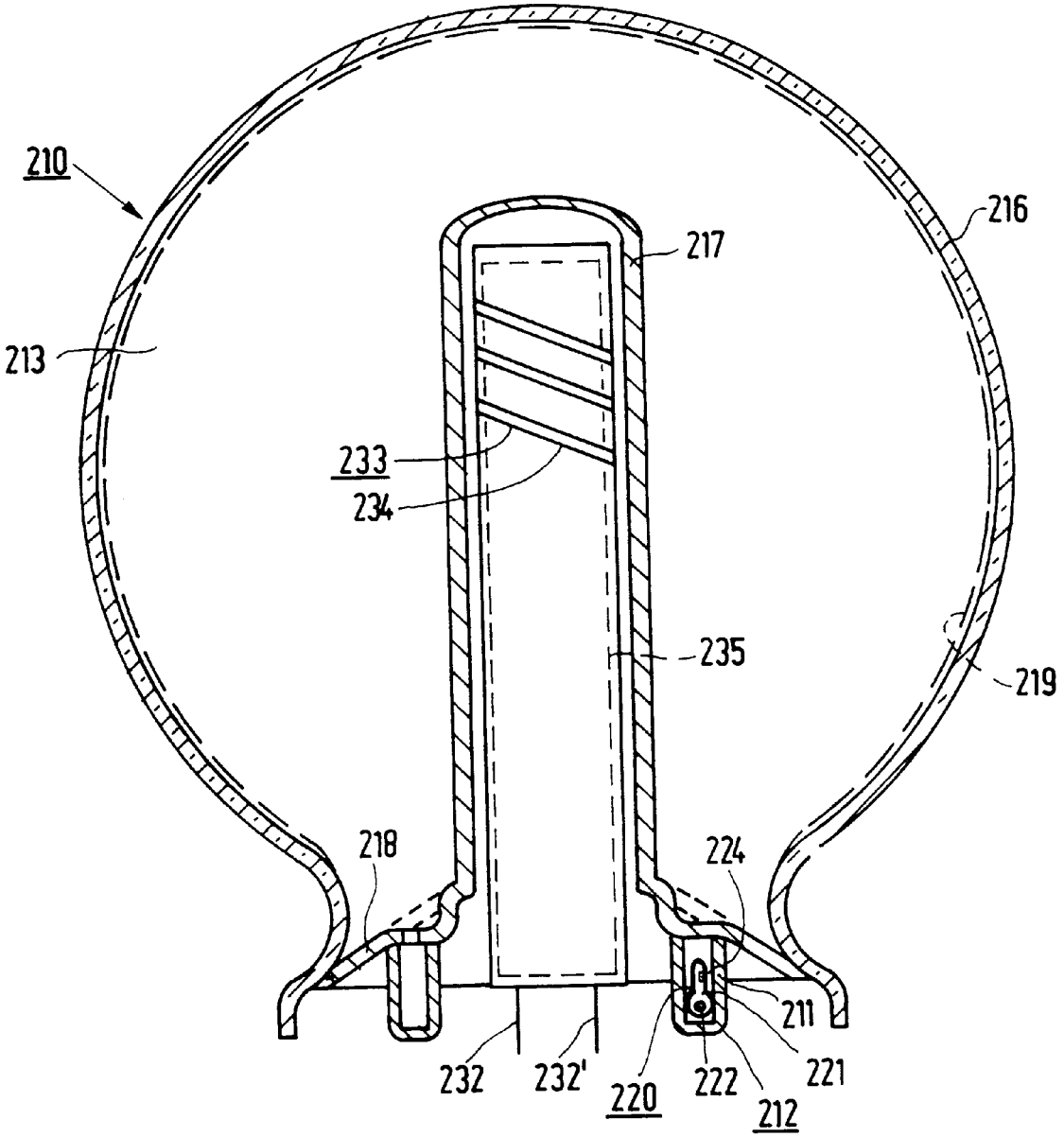
FIG. 4 shows a second embodiment of the low-pressure mercury discharge lamp according to the invention.

In FIG. 4, components corresponding to those of FIG. 1 have reference numerals which are 200 higher. The discharge vessel 210 in the embodiment of the lamp according to the invention shown in FIG. 4 has a pear-shaped enveloping portion 216 with a tubular recessed portion 217 which is connected to the enveloping portion 216 via a flanged portion 218. A capsule 220 is accommodated in a projecting portion 212 of the flanged portion 218 of the discharge vessel 210. The capsule 220 is accessible to radiation of at least a wavelength in a range from 100 nm to 5 $\mu$m through the wall portion 211 formed by the projecting portion 212. The wall 221 of the capsule 220 has a comparatively high absorption coefficient for this radiation compared with that of the wall portion 211 of the discharge vessel 210. The capsule 220 was fastened in the projecting portion 212 and opened in a manner corresponding to that described with reference to FIGS. 3A to 3C. A coil 233 provided with a winding 234 of an electrical conductor, forming means for maintaining an electric discharge in the discharge space 213, is arranged in the recessed portion 217 outside a discharge space 213 surrounded by the discharge vessel 210. The coil 233 is supplied with a high-frequency voltage, i.e. having a frequency higher than approximately 20 kHz, for example a frequency of approximately 3 MHz, via current supply conductors 232, 232' during operation. The coil 233 surrounds a core 235 of soft-magnetic material (shown in broken lines). Alternatively, a core may be absent. In a further embodiment, the coil is, for example, positioned inside the discharge space.

What is claimed is:

1. Method of manufacturing a low-pressure mercury discharge lamp comprising providing a radiation transmitting discharge vessel having a wall portion defining a projecting portion of said discharge vessel, said wall portion having an absorption coefficient for radiation, arranging a capsule containing mercury in said projection portion, said capsule having a glass wall, said glass wall having an absorption coefficient for radiation which is at least ten times the absorption coefficient of the wall portion, filling said discharge vessel with a rare gas, closing said discharge vessel containing said capsule and said rare gas, and heating said capsule by irradiation through said wall portion so that said glass wall softens and bulges outward under the influence of mercury vapor pressure, whereby said glass wall portion fixes itself against said wall portion of said projecting portion.

2. Method as in claim 1 wherein said capsule contains a rare gas.

3. Method as in claim 1 further comprising opening said capsule by irradiating said glass wall with radiation through said wall portion of said discharge vessel.

* * * * *